US007124580B2

(12) United States Patent
Paredes

(10) Patent No.: US 7,124,580 B2
(45) Date of Patent: Oct. 24, 2006

(54) SUB-ZERO CONDENSATION VACUUM SYSTEM

(75) Inventor: Hernan D. Paredes, San Pedro Sula (HN)

(73) Assignee: Crown Iron Works Company, Roseville, MN (US)

( * ) Notice: Subject to any disclaimer, the term of this patent is extended or adjusted under 35 U.S.C. 154(b) by 144 days.

(21) Appl. No.: 10/873,555

(22) Filed: Jun. 22, 2004

(65) Prior Publication Data

US 2005/0279089 A1 Dec. 22, 2005

(51) Int. Cl.

| | |
|---|---|
| ***F01B 1/00*** | (2006.01) |
| ***F02B 1/00*** | (2006.01) |
| ***F03G 7/00*** | (2006.01) |
| ***B01F 3/04*** | (2006.01) |
| ***F17C 9/02*** | (2006.01) |

(52) U.S. Cl. ..... 60/508; 62/121; 62/268; 165/111

(58) Field of Classification Search ..... 60/508; 62/121, 268; 165/111

See application file for complete search history.

(56) References Cited

U.S. PATENT DOCUMENTS

| | | | | |
|---|---|---|---|---|
| 4,068,710 A | | 1/1978 | Edwards | 165/111 |
| 4,312,646 A | * | 1/1982 | Fattinger et al. | 261/111 |
| 4,390,058 A | | 6/1983 | Otake et al. | 165/11.1 |
| 4,519,450 A | | 5/1985 | Kals | 165/114 |
| 4,551,981 A | * | 11/1985 | Banerjee | 62/70 |
| 4,911,854 A | | 3/1990 | Yokoyama et al. | 252/62.2 |
| 5,168,922 A | | 12/1992 | Senanayake | 165/111 |
| 5,207,068 A | * | 5/1993 | Bridden | 62/70 |
| 5,411,707 A | | 5/1995 | Hiatt | 422/68.1 |
| 5,444,986 A | * | 8/1995 | Hino | 62/66 |
| 5,501,269 A | | 3/1996 | Jenkins | 165/110 |
| 5,553,456 A | * | 9/1996 | McCormack | 62/59 |
| 5,632,329 A | | 5/1997 | Fay | 165/113 |
| 5,794,686 A | | 8/1998 | Baumann et al. | 165/114 |
| 5,925,291 A | * | 7/1999 | Bharathan et al. | 261/112.2 |
| 5,927,082 A | * | 7/1999 | Sidelnikov et al. | 62/70 |
| 5,950,717 A | | 9/1999 | Fay | 165/113 |
| 5,983,996 A | | 11/1999 | Romero | 165/111 |
| 6,101,029 A | | 8/2000 | Gaul et al. | 359/390 |
| 6,142,223 A | | 11/2000 | Bodas et al. | 165/183 |
| 6,145,818 A | * | 11/2000 | Herbst | 261/154 |
| 6,286,321 B1 | | 9/2001 | Glater | 62/55.5 |
| 6,286,589 B1 | | 9/2001 | Uehara | 165/166 |
| 6,311,510 B1 | | 11/2001 | Sunama et al. | 62/268 |
| 6,332,494 B1 | | 12/2001 | Bodas et al. | 165/112 |
| 6,360,543 B1 | | 3/2002 | Koronya et al. | 60/690 |
| 6,919,000 B1 | * | 7/2005 | Klausner et al. | 261/94 |
| 6,988,374 B1 | * | 1/2006 | Chang et al. | 62/282 |
| 2004/0188236 A1 | * | 9/2004 | Barve et al. | 203/1 |

* cited by examiner

*Primary Examiner*—Sheldon J Richter
(74) *Attorney, Agent, or Firm*—Nawrocki, Rooney & Sivertson, P.A.

(57) ABSTRACT

A pre-condenser is provided for condensation of water at sub-zero degree Celsius temperatures. A brine solution is cooled below 0 degrees Celsius and delivered to the pre-condenser. The brine solution contacts the vapors and gases from a scrubber, thereby condensing the vapors without allowing ice formation. A vacuum system connected to the pre-condenser removes the remaining gases from a top portion of the pre-condenser while the brine solution and condensed vapors are removed and recycled through a bottom portion of the pre-condenser.

10 Claims, 1 Drawing Sheet

SUB-ZERO CONDENSATION VACUUM SYSTEM

BACKGROUND OF THE INVENTION

1. Field of the Invention

The present invention relates generally to the field of direct contact pre-condensers. More specifically, the present invention relates to a sub-zero condensation vacuum system for pre-condensing water vapor for creating a vacuum.

2. Background of the Prior Art

In glycerine refining or any other steam distillation under vacuum, condensable and non-condensable vapors must be removed from the process stream in order to complete the refining process. The vapors from the process stream are removed by sending them directly in to a vacuum system in which the vapors can be condensed or otherwise removed.

In the area of condensers, it is known to provide a low pressure region into which vapor can exhaust, the condenser also having a condensate chamber for collecting the condensate.

Traditional vacuum systems, such as a steam ejector with contact or surface condensers, or hybrid systems with steam ejectors with condensers and a liquid ring vacuum pump are currently used to evacuate the gases and vapors in the glycerine refining process and in other such processes that require operation under a vacuum and use sparging or stripping steam.

SUMMARY OF THE INVENTION

The present invention provides a pre-condenser for condensing vapors at sub-zero degree Celsius temperatures without the formation of ice.

A brine solution is delivered from a brine storage tank to a brine metering pump. The brine metering pump is able to control the dispensing of brine solution to achieve a predetermined salt concentration. The resulting brine solution is cooled in a pre-condenser cooler to a sub-zero degree Celsius temperature.

A pre-condenser has a series of inlets for receiving the brine solution and dispensing the brine solution therein. A top portion of the steam condenser is connected to a vacuum system. A lower portion of the pre-condenser has an inlet for receiving vapors and gases from a scrubber, that are to be condensed in the pre-condenser.

The pre-condenser contains a packing material for maximizing contact between the brine solution and the vapors and gases. The brine solution travels toward the bottom of the pre-condenser by gravity while the vapors and gases travel counter-currently towards the top of the pre-condenser as a result of the connection to the vacuum system.

As the brine solution contacts the vapors, the vapors are condensed at sub-zero degree Celsius temperatures without the formation of ice. The condensed vapors are removed with the brine solution through an outlet in the lower portion of the pre-condenser. The remaining gases are removed through the top outlet via the vacuum system.

The brine solution leaving the pre-condenser is returned to the brine storage tank and may by recycled to repeat this process.

BRIEF DESCRIPTION OF THE DRAWING

The FIGURE is a schematic view illustrating the present invention.

DETAILED DESCRIPTION OF THE PREFERRED EMBODIMENTS

Figure 1:
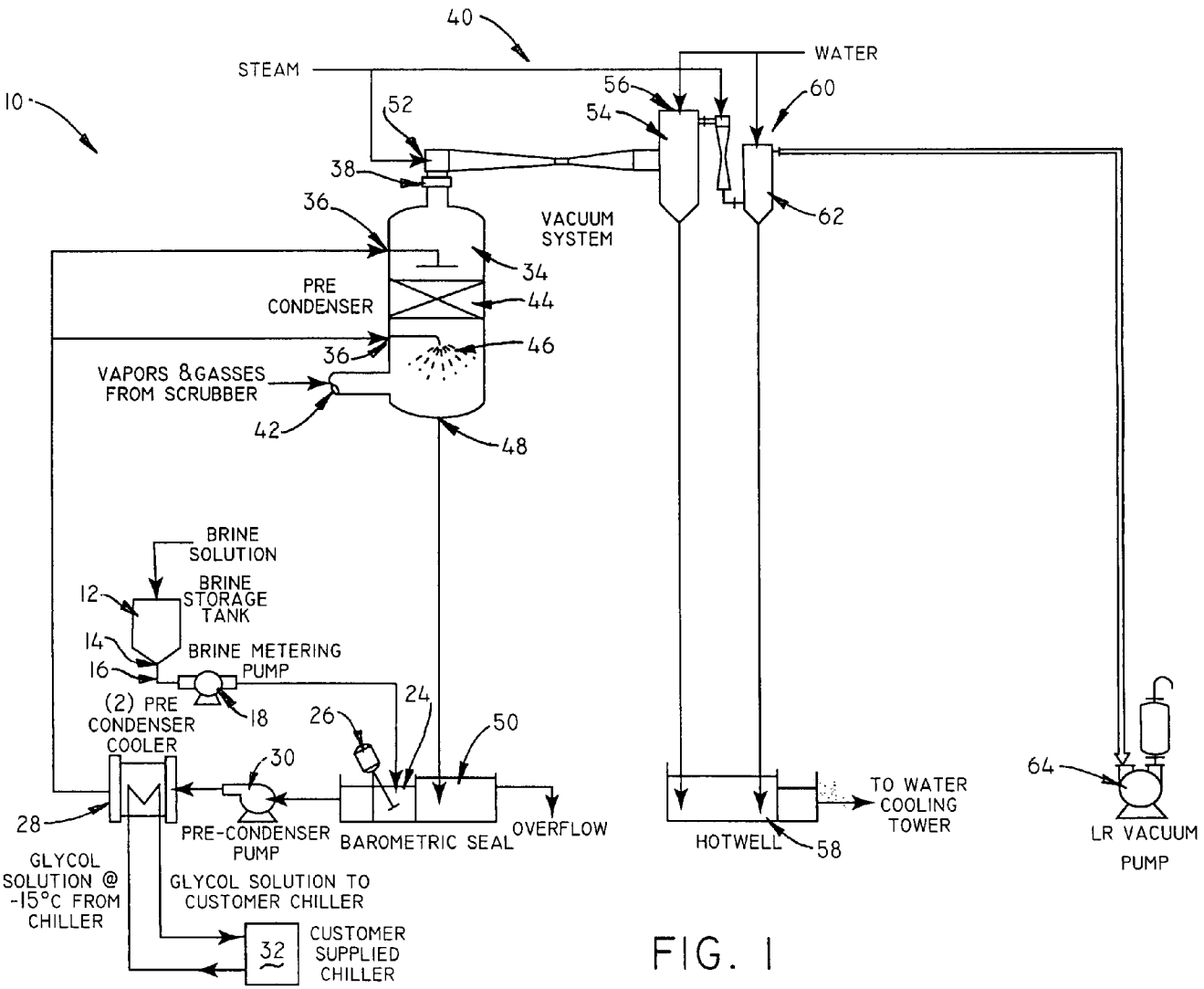

FIG. 1 illustrates an embodiment of a sub-zero degree Celsius pre-condenser system 10.

A brine storage tank 12 is shown having a brine solution therein, such as sodium chloride or a similar salt in water. The brine storage tank 12 has an outlet 14 that feeds to a line 16. The line 16 has a brine metering pump 18 wherein the brine is pumped through the line 16.

The brine is fed into a mixer 24 wherein the mixing means 26 therein allows the salt concentration to reach the predetermined concentration level.

The brine solution from the mixer 24 is then delivered to a pre-condenser cooler 28 by a pre-condenser pump 30. The pre-condenser cooler 28 cools the brine by supplying a chilled glycol solution from a chiller 32. It is contemplated that the chilled glycol solution be at −15 degrees Celsius when delivered to the pre-condenser cooler. The glycol solution cools the brine solution by surface contact and then the glycol solution is returned to the chiller 32.

It is contemplated that the brine solution should be cooled in the pre-condenser cooler to a temperature below 0 degrees Celsius so that the brine solution can be used to condense water vapor at sub-zero temperatures without the occurrence of ice formation.

The chilled brine solution is fed from the pre-condenser cooler 28 to a pre-condenser 34. The pre-condenser 34 has one or more inlets 36 in a sidewall for delivering chilled brine solution thereto. The pre-condenser 34 has a top portal 38 for connection to a vacuum system 40.

A vapor and gas inlet 42 is positioned at a bottom portion of the pre-condenser 34 for receiving vapor and gases from a process stream.

The vacuum system 40 causes the vapor and gases to travel upwardly within the pre-condenser 34 as the vapor and gases come into contact with the chilled brine solution. The brine solution is dispensed to various parts of the pre-condenser 34 and travels downwardly due to gravity.

At least a portion of the pre-condenser 34 is filled with a packing material 44 to increase the contact surface area of the chilled brine solution to improve both heat and mass transfer. This increases the contact between the chilled brine solution as it travels counter current against the upward flow of the vapors and gases.

The chilled brine solution is dispersed within the chamber of the pre-condenser by a dispensing means 46 so as to provide maximum coverage and dispersion within the chamber of the pre-condenser 34. A dispensing means 46 is positioned vertically above the inlet 42 for the vapors and gases to initiate condensation of the vapors and gases.

The vapors are cooled by the brine solution to a sub-zero temperature and condensed as slightly diluted brine without any ice formation. The condensation at temperatures below 0 degrees Celsius generates the vacuum required in the process. The resulting brine solution is transferred by gravity through the outlet 48 in the bottom of the pre-condenser 34 and returned to the brine barometric seal 50. From the barometric seal 50, the brine can be re-circulated with the brine pump 18.

The water vapor load of the gas and vapor leaving the gas outlet of the pre-condenser is drastically reduced, such that the size of the vacuum system 40 and utilities consumption required to remove the remaining vapor and gas are greatly reduced as a result of the sub-zero pre-condenser system 10.

The residual gases can be sent to a vacuum system 40 such as a vacuum system having steam ejectors with condensers and/or a liquid ring vacuum pump to evacuate the residual gases to the atmosphere.

As shown, the vacuum system 40 may include a steam inlet 52 positioned near the outlet 38 of the pre-condenser 34 allowing the steam to extend through the structure of the vacuum system 40 to a vessel 54 having a water inlet 56 at a top portion and connected to a hot well 58 at a bottom portion. The vessel 54 is connected to yet another similar vacuum system 60 that receives steam and water therein wherein this second vacuum system 60 has a second vessel 62 that is likewise connected to the hot well 58. The entire combination of the first and second vacuum systems 40, 60 are operated in conjunction with a vacuum pump 64 connected to the second vessel 62.

What is claimed is:

1. An apparatus for condensing vapors at temperatures below 0 degrees Celsius, said apparatus comprising:

a. A vessel for condensing vapors therein;

b. A liquid inlet in a sidewall of said vessel for receiving cooled liquid therein;

c. A vapor inlet in a lower portion of said vessel for receiving vapor therein;

d. A vacuum system connected to a top portion of said vessel for drawing vapors upwardly within said vessel;

e. A dispensing means for dispensing cooled liquid counter currently with respect to said vapors f. A liquid outlet in a lower portion of said vessel for removing condensed vapors from said vessel; and g. a pre-condenser cooler for cooling the cooled liquid to a temperature below 0 degrees Celsius.

2. The apparatus according to claim 1, said apparatus further comprising a brine metering system for dosing the cooled liquid with a brine solution.

3. The apparatus according to claim 2, said apparatus further comprising a packing material positioned within said vessel for increasing contact surface therein.

4. The apparatus according to claim 3, said apparatus further comprising a plurality of dispensing means for dispensing the cooled liquid within said vessel.

5. A system for condensing a vapor, said system comprising:

a. A brine solution cooled to a temperature below 0 degrees Celsius;

b. A vessel for receiving and dispensing the brine solution therein;

c. A vapor delivered to said vessel;

d. A vacuum system connected to said vessel for drawing said vapor upwardly within said vessel;

e. Said brine solution moving in counter flow to said vapor, condensing said vapor as said brine solution contacts said vapor;

f. An outlet for removing said brine solution and said condensed vapor from said vessel.

6. The system according to claim 5, said system further comprising a pre-condenser cooler for cooling said brine solution before said brine solution enters said vessel.

7. The system according to claim 6, said system further comprising a dispensing system for dispensing said brine solution within said vessel.

8. The system according to claim 7, said system further comprising a packing material within said vessel.

9. A method for pre-condensing vapors from a scrubber at temperatures below zero degrees Celsius, said method comprising the steps of:

a. cooling a brine solution to a temperature below zero degrees Celsius;

b. dispensing said brine solution within a pre-condenser;

c. delivering a vapor to said pre-condenser;

d. condensing said vapor by contacting said vapor with said brine solution;

e. cooling said brine solution in a pre-condenser cooler; and f. pulling a vacuum within said pre-condenser for allowing said vapors to flow upwardly within said pre-condenser.

10. The method according to claim 9, said method further comprising the steps of flowing the brine solution counter current with respect to said vapors within said pre-condenser.

* * * * *